United States Patent [19]

Wang

[11] Patent Number: 4,886,475

[45] Date of Patent: Dec. 12, 1989

[54] STEERING APPARATUS FOR AN INFLATABLE RAFT

[76] Inventor: Cheng C. Wang, 12 Fl., No. 440, Jen-Ai Rd., Sec. 4, Taipei, Taiwan

[21] Appl. No.: 234,883

[22] Filed: Aug. 22, 1988

[51] Int. Cl.[4] ..... B63H 16/20

[52] U.S. Cl. ..... 440/27

[58] Field of Search ..... 440/21, 26–31, 440/90; 192/20, 21, 41 R, 41 S, 43.2, 45.1, 70.28, 70.3, 90

[56] References Cited

FOREIGN PATENT DOCUMENTS 492547 5/1953 Canada ..... 440/26

2311711 12/1976 France ..... 440/26

*Primary Examiner*—Joseph F. Peters, Jr.

*Assistant Examiner*—Jesus D. Sotelo

*Attorney, Agent, or Firm*—Ladas & Parry

[57] ABSTRACT

A steering apparatus for an inflatable raft is disclosed. The apparatus substantially includes a transmission member having a transmission shaft formed thereon, a driving member having a driving shaft formed thereon which is co-axially arranged with the transmission shaft, a coupler having a central bore in the same shape as that of the transmission and driving shafts and movably sleeved thereon, a bias member biasing between the coupler and either of the transmission and driving members, and an actuating member for causing the coupler to move from an original engaged position to a disengaged position. When the user of the raft controls the steering apparatus at either side of the raft, the impellers at the side of the controlled apparatus will stop turning along with the manipulation of the pedals by the user so as to achieve an alternation of the moving direction of the raft.

9 Claims, 6 Drawing Sheets

STEERING APPARATUS FOR AN INFLATABLE RAFT

BACKGROUND OF THE INVENTION

The present invention relates to an automatic steering apparatus for an inflatable raft, and more particularly to an improved apparatus for controlling the moving direction of an inflatable raft.

A conventional inflatable raft for amusement and recreational purposes is shown in FIG. 1. The raft 100 is preferably made of an impervious sheet plastic material and has a pair of pedals 101 operated by the user to actuate the impellers 102 causing the raft to move forward or backward. It is easy to appreciate that this conventional inflatable raft cannot be moved in the direction that the user desires. It is also noted that the impeller vanes may be very easily damaged when the raft is in the water and collides with another boat.

SUMMARY OF THE INVENTION

It is therefore the main object of the present invention to provide a steering apparatus for an inflatable raft which can enable the same to move in a desired direction.

Another object of the present invention is to provide a lifting apparatus for said steering apparatus which can raise the steering apparatus together with the impeller vanes to a relatively high level, with respect to the water's surface, to prevent damage to said impellers.

Accordingly, a steering apparatus for an inflatable raft comprises a transmission member connected to the pedals of the raft, a driving member for the impellers to be connected thereto and installed in alignment with said transmission member, a coupler attaching said transmission member to said driving member for controlling the latter to rotate along with the former, an elastic member biasing said coupler to engage with both the transmission member and the driving member, and an actuating means in contact with said coupler causing it to move from a first engaged position to a second disengaged position. When the coupler is actuated by the actuating means to move to the disengaged position, the impeller will not turn along with the action of moving the pedals so that the moving direction of the raft can be controlled.

The steering apparatus according to the present invention can be installed on a lifting member whereby the apparatus together with the impellers can be raised to a higher level, with respect to the water's surface, to avoid damages of the impellers.

BRIEF DESCRIPTION OF THE DRAWINGS

These and other objects, features and advantages of the steering apparatus, according to the present invention, will become apparent from the following detailed description of the preferred embodiments with reference to the accompanying drawings, wherein.

DETAILED DESCRIPTION OF THE PREFERRED EMBODIMENTS

Figure 1:
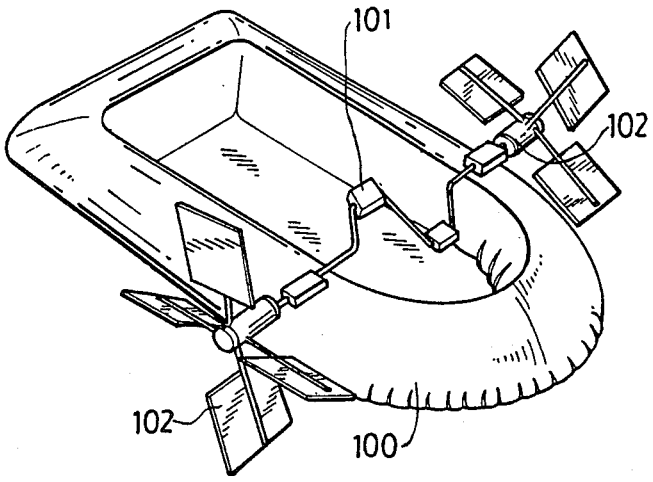
FIG. 1 PRIOR ART
FIG. 1 is a perspective view of a conventional inflatable raft.
Figure 2:
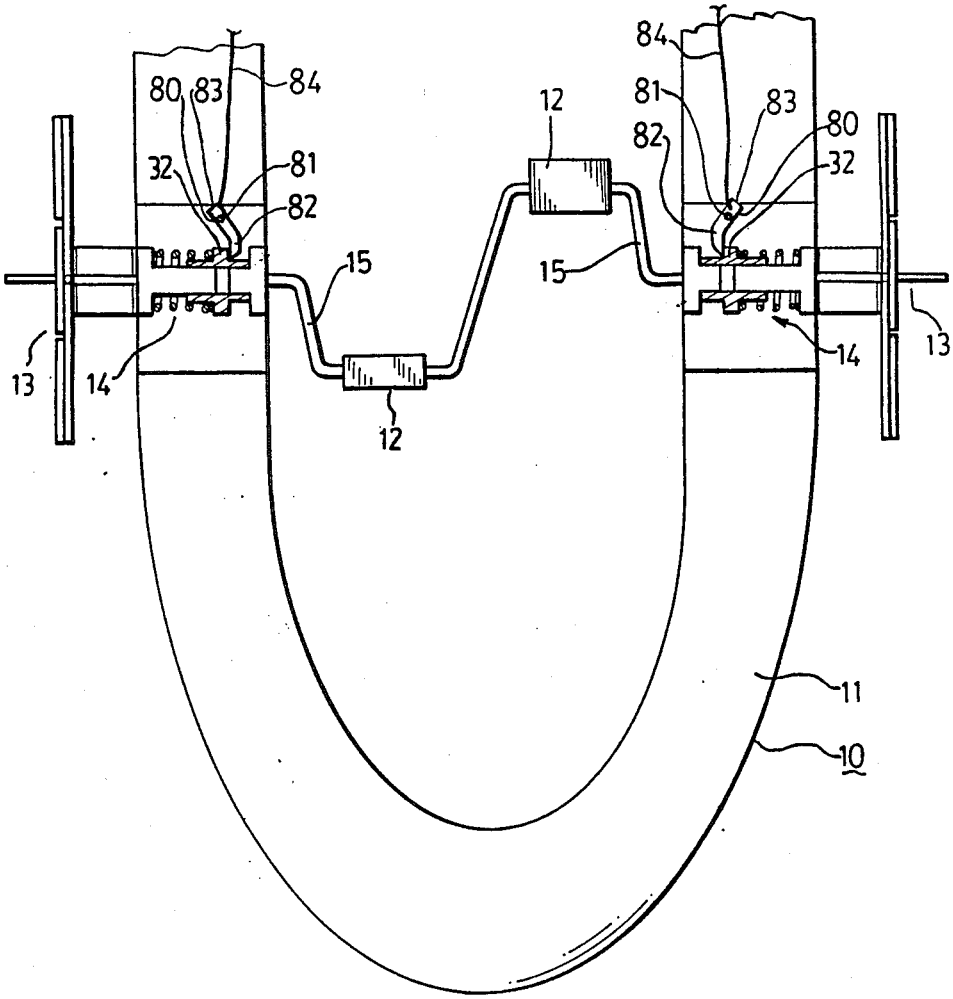
FIG. 2 is an elevated view of an inflatable raft according to the present invention.

Referring to FIG. 2 which shows a perspective view of the inflatable raft, according to the present invention, the raft 10 includes a raft body 11, a pair of driving pedals 12 and a pair of impellers 13 each further including a plurality of vanes corresponding to the structure of the conventional inflatable raft shown in FIG. 1. At both lateral sides of the raft, there is a steering apparatus 14 provided to be connected between the transmission rods 15 of the pedals 12 and the impellers 13.

Figure 4:
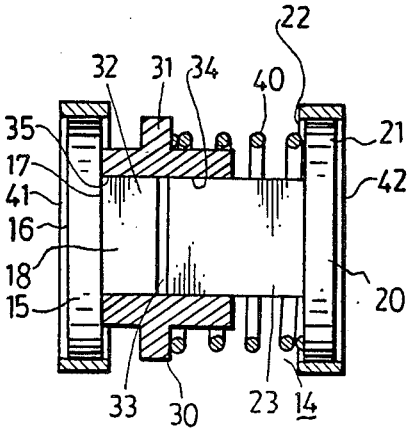
FIG. 4 is an enlarged sectional view of the steering apparatus according to the present invention.
Figure 3:
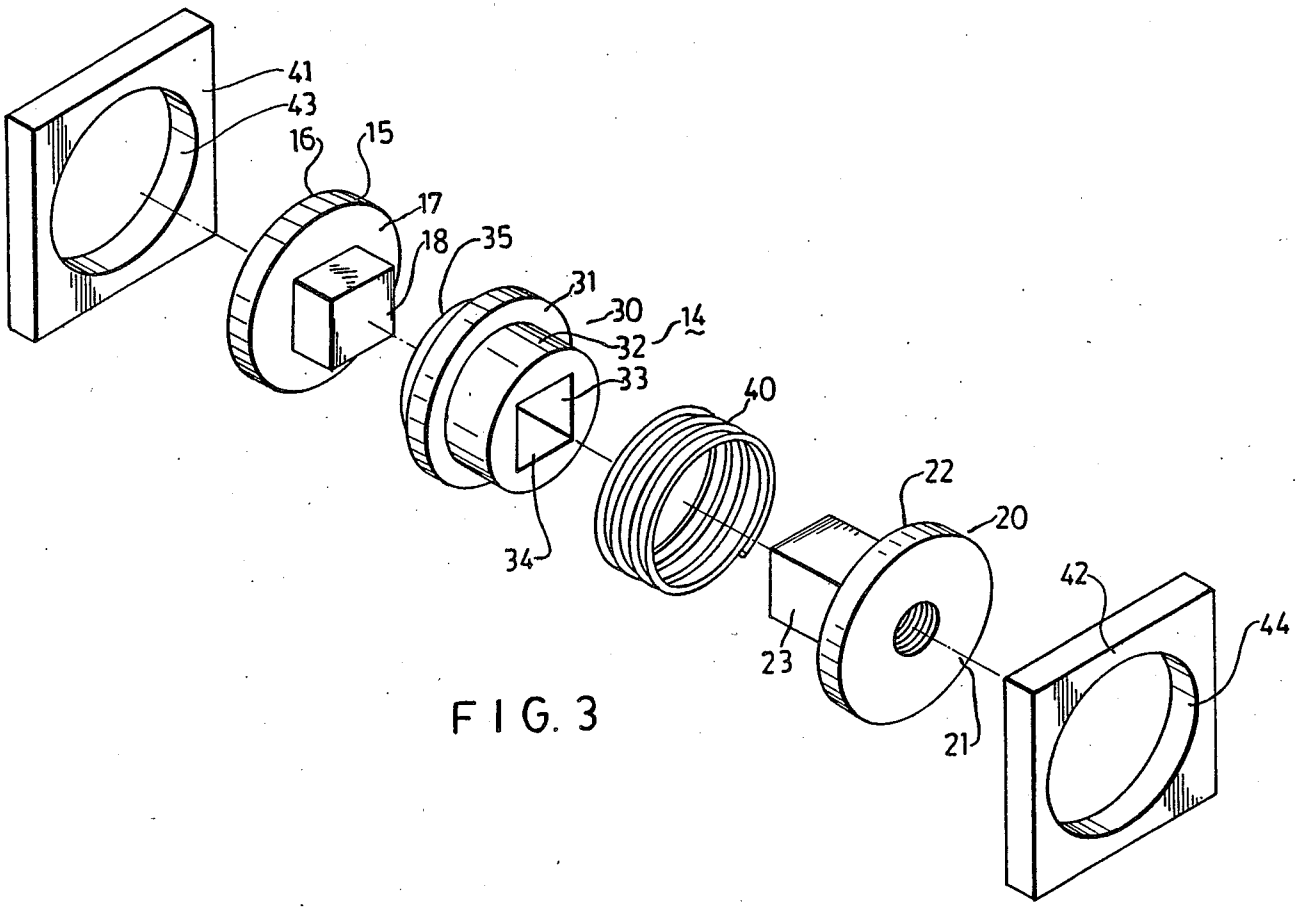
FIG. 3 is an enlarged and exploded perspective view of the steering apparatus in the raft of the present invention.

The steering apparatus 14 is best shown in FIGS. 3 and 4, where enlarged, exploded and sectional views have been choosen for the purpose of better illustrating the structure of the same. The steering apparatus 14 includes a transmission member 15 which is substantially disc-shaped having a first surface 16 connected by said transmission rods 15 of the pedals 12 and a second surface 17 with a square transmission shaft 18 extending therefrom, a driving member 20, also disc-shaped, having a first surface 21 on which is connected the impeller assembly and a second surface 22 with a driving shaft 23 extending therefrom, a tubular coupler 30 having an annular flange 31 formed on the outer surface 32 thereof, a central bore 33 with a square section corresponding to the square section of said transmission block 18 and said driving shaft 23 with a first end 34 and a second end 35 sleevingly and movably connected to said transmission and driving shafts 18, 23 respectively, and an elastic biasing member 40, which is substantially a coil spring, disposed between the flange 31 of the coupler 30 and the second surface 22 of the driving member 20. The transmission member 15 and the driving member 20 are contained in bearing housings 41 and 42 respectively with the disc portions thereof matching the bearing recesses 43, 44 as shown in FIGS. 3 and 4. Referring to FIG. 2, the steering apparatus 14 also includes an actuating means 80 revealed in the structure of a lever having a pivot 81 fixed on the raft and passing through the pivotal position thereof. The actuating lever 80 has a pawl 82 touching the flange 31 of the coupler 30 and a tail portion 83 at the opposing end of said pawl 82, with respect to the pivot 81. A rope 84 can be connected to the tail portion 3 of the actuating lever 80 and extended therefrom to a suitable location where the user can easily actuate said lever via pulling the rope 84.

Figure 5:
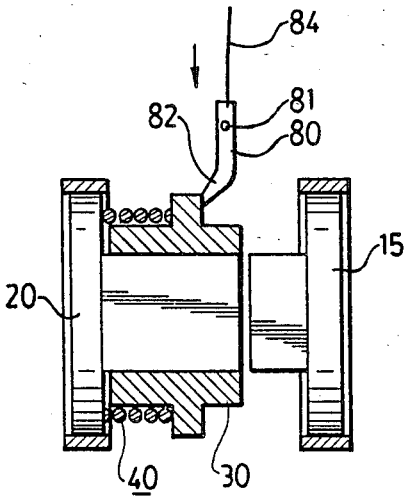
FIG. 5 is an enlarged sectional view of the steering apparatus according to the present invention showing the coupler in a disengaged position.

In operation, the steering apparatus 14 is controlled by the user of the inflatable raft for the purpose of altering the moving direction of the raft. Referring to FIG. 2, if both the steering apparatuses 14 equipped on both sides of the raft are not actuated, the user can manipulate the pedals 12 to cause the raft to move in either a forward or a backward direction. If the user wishes to turn the moving direction of the raft, to the right for example, the steering apparatus 14 on the right side of the raft would be actuated by the user to pull the rope 4 of the actuating lever 80. Referring particularly to FIG. 5 which shows a sectional view of the steering apparatus 14 after the same has been actuated by the user, it is easy to understand that the actuating lever 80 will turn clockwise with respect to the pivot 81. The pawl 82 then pushes the coupler 30 to move to the left from an engaged position to a disengaged position. Now the coupler 30 no longer couples both the transmission shaft 18 and the driving shaft 20. In other words, the transmission member 15 is not connected to the driving member 20, and thus the impellers on the right side will not turn when the user manipulates the pedals 12. Since the steering apparatus 14 on the left side of the raft is not actuated, the impellers on the left side will continue to turn as long as the user keeps on manipulating the pedals 12, so that the raft will alter its moving direction to the right accordingly. When the moving direction of the raft has been adjusted as desired, the user may release the rope 84 of the actuating lever 80, allowing the coupler 30 of the steering apparatus 14 to move back to its original engaged position due to the restored force of the biasing spring 40. The raft will then continue moving in the new adjusted direction. It is easy to be understood that the operation of controlling the raft to turn to the left is just like the operation stated hereinabove, except that the steering apparatus 14 on the left side of the raft is actuated. Therefore, this operation of turning the raft to the left shall not be detailed herewith.

Figure 6:
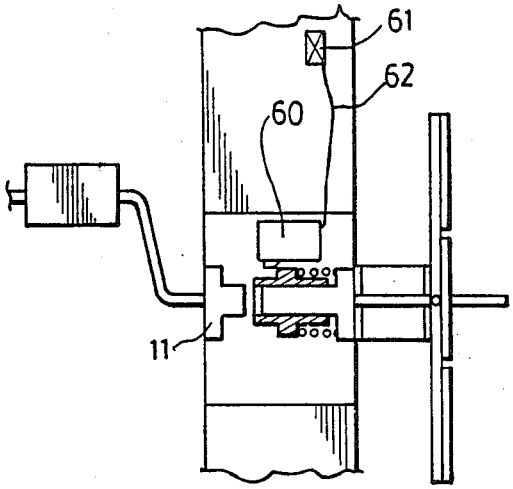
FIG. 6 is an elevated view of a second embodiment of the steering apparatus according to the present invention.
Figure 7:
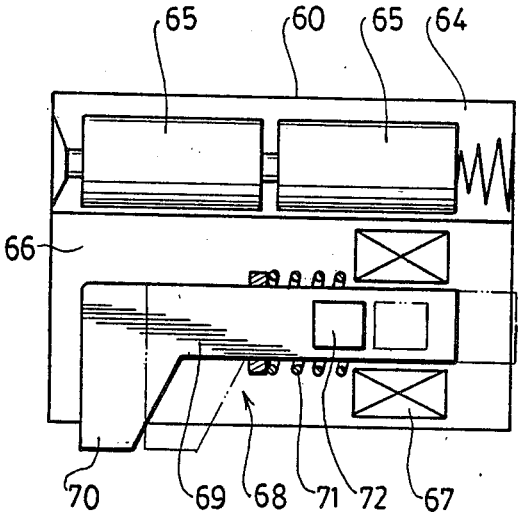
FIG. 7 is an enlarged sectional view of the actuating member used in the steering apparatus of the present invention.

Referring to FIGS. 6 and 7 which show a second embodiment of the actuating means adopted in the steering apparatus of the present invention, the actuating means 60 is disposed adjacent to the coupler of the apparatus and has a pair of leading electrical wires 62 extending therefrom to connect to a control switch 61. The interior structure of the actuating means 60 is best shown in FIG. 7. The actuating means 60 includes a first chamber 64 formed therein for containing a pair of dry batteries 65, and a second chamber 66 for the installation of an electromagnet 67 and an actuating mamber 68. The actuating member 68 further includes a bar 69 stretched into said electromagnet 67, an actuating inclined surface 70 formed at one end of the bar 69, and a biasing spring 71 provided between the bar 69 and the electromagnet. The bar 69 is ideally provided with a permament magnet 72 therein for reinforcing the effect of electromagnetic inter-reaction with the electromagnet 67.

In operation, again referring particularly to FIG. 7, when the user closes the electric switch 61, the magnetic force of the electromagnet 67 will cause the bar 68 to move to the right, to a position as shown in by the dotted lines. The inclined surface 70, in touch with the coupler 30 of the steering apparatus, will push and force the coupler 30 to move from its engaged position to a disengaged position. When at rest, the parts of the apparatus are in exactly the same position as that shown in FIGS. 2 to 5 and shall not be detailed hereinwith.

Figure 8:
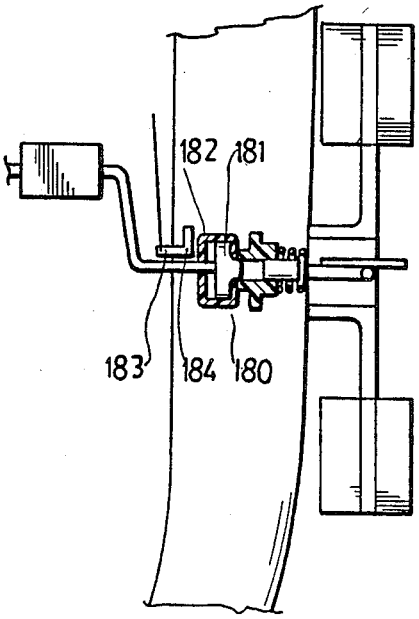
FIG. 8 is an elevated view of a third embodiment of the steering apparatus according to the present invention.

Referring to FIG. 8 which shows a sectional view of a third embodiment of the steering apparatus according to the present invention, it is seen that the structure of the steering apparatus 180 is mostly like that of FIGS. 2 to 5 except that the transmission member 181 is installed in a movable casing 182 instead of a bearing housing 41. The actuating means 183, when actuated through the manipulation of the rope thereof by the user, will push and force the movable casing 182 to in turn push and force the coupler to move from an engaged position to a disengaged position. It is easy to understand that the operation of the steering apparatus 180 in this third embodiment is like that of the apparatus in FIGS. 2 to 5 except that the actuating means 183 pushes the movable casing 182 instead of the coupler.

Figure 9:
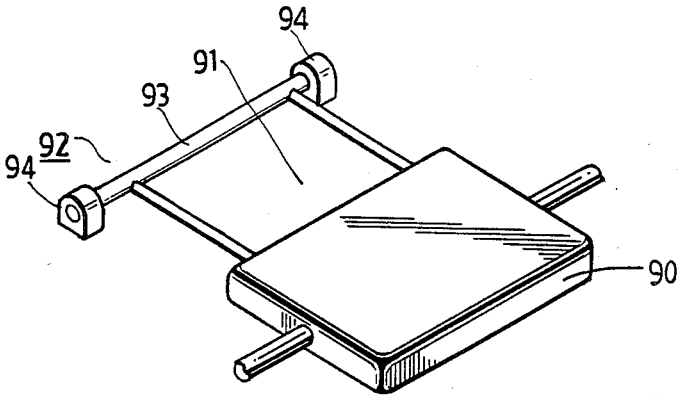
FIG. 9 is a perspective view of the inflatable raft having a lifting member for the steering apparatus and the impellers.
Figure 10:
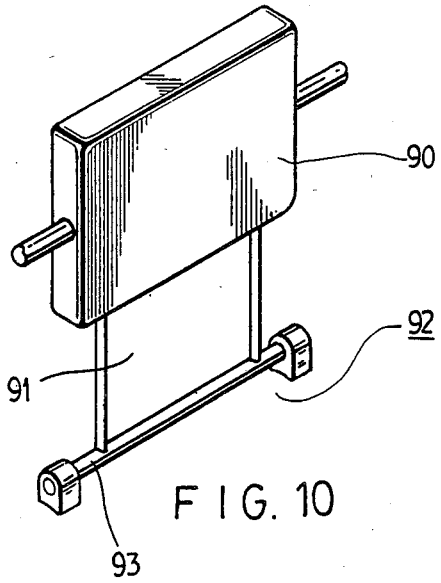
FIG. 10 is a perspective view of the inflatable raft of the present invention showing the lifting member in a raised position.

Referring to FIGS. 9 and 10 where the perspective views of an inflatable raft wherein a lifting means is provided are shown, the steering apparatus 14 is stored in a housing 90 which is installed on a lifting member 91 of a lifting means. The lifting member 91 is generally plate-shaped with one edge thereof connected to a pivotal means 92 on the raft. As shown in FIG. 10, the lifting member 91, together with the steering apparatus 14 stored in the housing 90, can be raised to a relatively higher position in respect to the water's surface. The pivotal means 92 may be in the form of a pivotal shaft 93 supported by a pair of shaft holders 94 on the raft. It is easy to see that when the steering apparatus and the impellers are lifted to a relatively high position in respect to the water's surface, the possibility of damages to impellers, resulting from collision with other rafts, is greatly reduced.

Although the steering apparatus in an inflatable raft of the present invention has been described hereinabove by way of preferred embodiments, it should be noted that other changes and modifications may still be made by those skilled in the art without departing from the spirit of the present invention.

What I claim is:

1. A steering apparatus for an inflatable raft having a raft body made of a gas-impervious sheet material, a pair of pedals to be manipulated by a user, a pair of impeller assemblies provided at lateral sides of the raft and a power transfer means connected between said pedals and said impeller assemblies; said latter means comprising:

a transmission means including a substantially disc-shaped transmission member, said transmission member having a transmission shaft formed on one surface thereof and protruding therefrom, said shaft being positioned at the central portion of said transmission member and having a sectional plane containing at least one straight side, said transmission member being connected to said pedals;

a driving means;

a coupling means positioned between and movably sleeved onto said transmission shaft and said driving means;

a bias spring disposed between said coupling means and one of said driving means and said transmission means for biasing said coupling means in an engaged position with said transmission means and said driving means; and an actuating means attached to said coupling means for causing said coupling means to move from said engaged position to a disengaged position for disengaging said transmission means from said driving means;

whereby said transmission means can be disengaged from said driving means through the actuation of said actuating means to move said coupling means, thus stopping the impellers which are connected to the disengaged driving means from turning and obtaining an adjustment of the moving direction of the raft.

2. A steering apparatus according to claim 1 wherein said driving means includes a substantially disc-shaped driving member, said driving member having a driving shaft formed on one surface thereof and protruding toward said transmission shaft of said transmission member, said driving shaft having a sectional plane similar to that of said transmission shaft and being positioned co-axially with said transmission shaft, said driving member being connected to the impeller assemblies of the raft.

3. A steering apparatus according to claim 2 wherein said coupling means has a central bore with a sectional plane identical to that of said transmission shaft and said driving shaft, said central bore being positioned between and movably sleeved onto said transmission shaft and said driving shaft.

4. A steering apparatus according to claim 3 wherein said coupling means further comprises an annular flange formed thereon, said bias spring touching said flange and said actuating means being effective for pushing said flange of said coupling means.

5. A steering apparatus according to claim 3 wherein said actuating means comprises an actuating lever having one end thereof in the form of a pawl member for engaging with said coupling means and an opposing end, a pivot passing through said actuating lever at a pivotal position, and a rope connected to said opposing end.

6. A steering apparatus according to claim 3 wherein said actuating means comprises an actuating bar having an actuating inclined surface formed thereon attached to said coupling means, an electromagnet generating an electromagnetic force attracting said actuating bar to move to a disengaged direction, and a biasing means disposed between said actuating bar and said electromagnet for restoring said actuating bar to a normal engaged position; said actuating bar moving in said disengaged direction with said actuating inclined surface pushing said coupling means to move to said disengaged position.

7. A steering apparatus according to claim 6 wherein said actuating bar further comprises a permanent magnet formed therein, said permanent magnet being adjacent to said electromagnet.

8. A steering apparatus according to claim 3 further comprising a substantially plate-shaped lifting member with one side thereof connected to a housing enclosing said transmission means, said driving means and said coupling means, and a pivot means connected to another side of said lifting member; whereby, said lifting member can be lifted by rotation of the same with respect to said pivot means.

9. A steering apparatus according to claim 8 wherein said pivot means includes a pivotal member and a pair of supporters on said raft for supporting said pivotal member at its two ends thereof.

* * * * *